US007975641B1

(12) United States Patent
Pittner et al.

(10) Patent No.: US 7,975,641 B1
(45) Date of Patent: Jul. 12, 2011

(54) TENNIS SCORING SYSTEM

(76) Inventors: Dusan Pittner, Easton, MA (US); Ida Pittnerova, Easton, MA (US)

( * ) Notice: Subject to any disclaimer, the term of this patent is extended or adjusted under 35 U.S.C. 154(b) by 190 days.

(21) Appl. No.: 12/381,783

(22) Filed: Mar. 17, 2009

Related U.S. Application Data

(60) Provisional application No. 61/069,710, filed on Mar. 17, 2008.

(51) Int. Cl.
*A63B 71/06* (2006.01)

(52) U.S. Cl. ..... 116/225; 273/DIG. 26

(58) Field of Classification Search ..... 116/222–225, 116/306, 321–323, 334, 335, DIG. 41; 235/1 B; 273/DIG. 26; 340/323 R, 323 B; 377/5; 700/91, 92; D10/46.1
See application file for complete search history.

(56) References Cited

U.S. PATENT DOCUMENTS

| | | | | | |
|---|---|---|---|---|---|
| 1,597,767 | A | * | 8/1926 | Conover | 116/224 |
| 2,055,518 | A | * | 9/1936 | Craig | 116/225 |
| 2,664,648 | A | * | 1/1954 | Young | 434/405 |
| 4,132,187 | A | * | 1/1979 | Moebius | 116/225 |
| 4,158,342 | A | * | 6/1979 | Scruggs | 116/225 |
| 4,189,143 | A | * | 2/1980 | Van Auken et al. | 116/222 |
| 4,831,956 | A | * | 5/1989 | Thater | 116/222 |
| 5,329,874 | A | * | 7/1994 | Posey | 116/222 |
| 5,489,122 | A | * | 2/1996 | Pittner | 283/49 |
| D419,459 | S | * | 1/2000 | Dickson | D10/46.1 |
| 6,210,296 | B1 | * | 4/2001 | Gabriel | 473/464 |

FOREIGN PATENT DOCUMENTS

| | | | | |
|---|---|---|---|---|
| DE | 3925932 | A1 | * | 2/1991 |
| FR | 2577333 | A1 | * | 8/1986 |
| GB | 2355203 | A | * | 4/2001 |
| JP | 2005103210 | A | * | 4/2005 |

* cited by examiner

*Primary Examiner* — R. A. Smith
(74) *Attorney, Agent, or Firm* — William Nitkin

(57) ABSTRACT

A tennis scoring system utilizing a display unit having a plurality of colored indicia areas disposed within at least a first and second scoring bar, each of such colored indicia areas of the first and second scoring bars representing, respectively, the games and sets to be won by the first and second players, each of such colored indicia areas in the first and second scoring bars to be changed in color in sequence whenever a player wins a game, such changed colored indicia representing the scores of games and sets won by the two players in a tennis match.

19 Claims, 3 Drawing Sheets

TENNIS SCORING SYSTEM

This application claims priority and benefit of a provisional patent application entitled Game Set Match Scoring Device, Ser. No. 61/069,710 filed Mar. 17, 2008, now pending.

BACKGROUND OF THE INVENTION

1. Field of the Invention

The device and method of this invention reside in the field of scoring devices and more particularly relates to a tennis score keeping device that is visible to players and spectators alike and its method of use.

2. History of the Prior Art

Many of the prior art tennis score keeping devices are kept on players' wrists, similar to a wristwatch, or are mounted on a tennis racket. Some of these devices, being of a small size, are difficult to manipulate and read. Other scoring devices of the prior art are large, sign-like devices that are comprised of very complex structural displays that can be difficult to set the numerical components and are hard to quickly and easily read.

Visual scorekeepers are well known in the prior art such as taught in U.S. Pat. No. 5,329,874 to Posey which discloses a portable structure having plates bearing numbers suspended from notches on both sides of an elongated support member. The plates are manipulated by an assistant so that they appropriately display the score of the tennis match.

A co-inventor of the present invention has invented a device entitled Personal Tennis Score Keeper in U.S. Pat. No. 5,489,122 which teaches a hand held or racquet-mounted device having an array of squares in three columns bearing indicia indicating the number of games won by a first player in one column and the number of games won by an opposing player in the other column with slideably secured, adjustable markers to indicate the game scores.

SUMMARY OF THE INVENTION

It can be difficult for tennis players to keep in mind not only the score of the current game they are playing but also the score of previous games and set(s) in a tennis match. It is an object of this invention to free the players from this mental burden as well as to prevent disputes over scores of past games played in a match.

The system of this invention provides an enlarged display scoring device that can be mounted on the tennis net for easy visibility by both players and spectators, allowing the viewer to quickly know at a glance the current status of the tennis match in games and set(s) won.

It is a further object of the system and method of this invention to record the scoring of games and sets won in a tennis match in a manner that is equally visible to the players, coaches, tournament officials and spectators alike.

It is a still further object of this invention to provide an inexpensive device that can be owned and used by individual tennis players when they play tennis as well as one that is permanently mounted for use on school tennis courts or on public tennis courts.

DESCRIPTION OF THE PREFERRED EMBODIMENT(S)

For a tennis player, keeping track of the score of the games and sets of a match is a lengthy and complicated process. A tennis match consists of a certain number of sets, and each set consists of a certain number of games. Each game consists of a certain number of points. At least four points are needed to be won in order to win a game. At least six games need to be won in order to win a set, and at least two sets need to be won in order to win a match. If the score of the games in a set is 6-6, a seventh game is played to determine the winner of that set.

Figure 1:
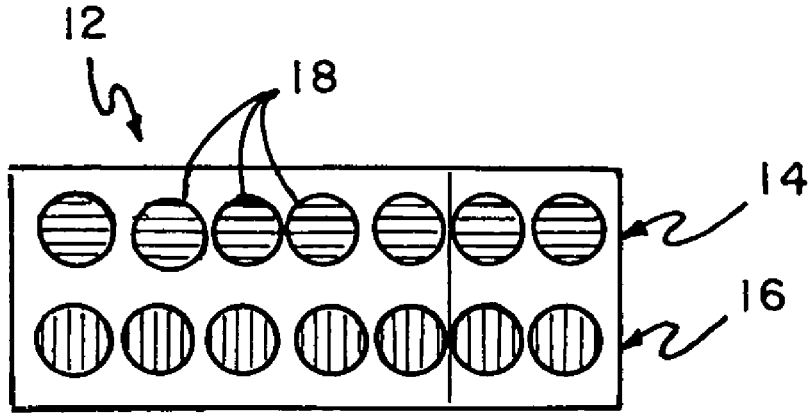
FIG. 1 illustrates a front view of the tennis scoring device of this invention prior to playing the first game having two scoring bars, one for each player, with one scoring bar positioned above the other.

FIG. 1 illustrates one embodiment of the tennis scoring device of this invention being a front view of a display unit 12 that can be positioned on a tennis net to be visible by the players on both sides of net or, in another embodiment, two scoring devices can be used with one positioned on one side of the net and the other device positioned on the other side of the net.

Figure 4:
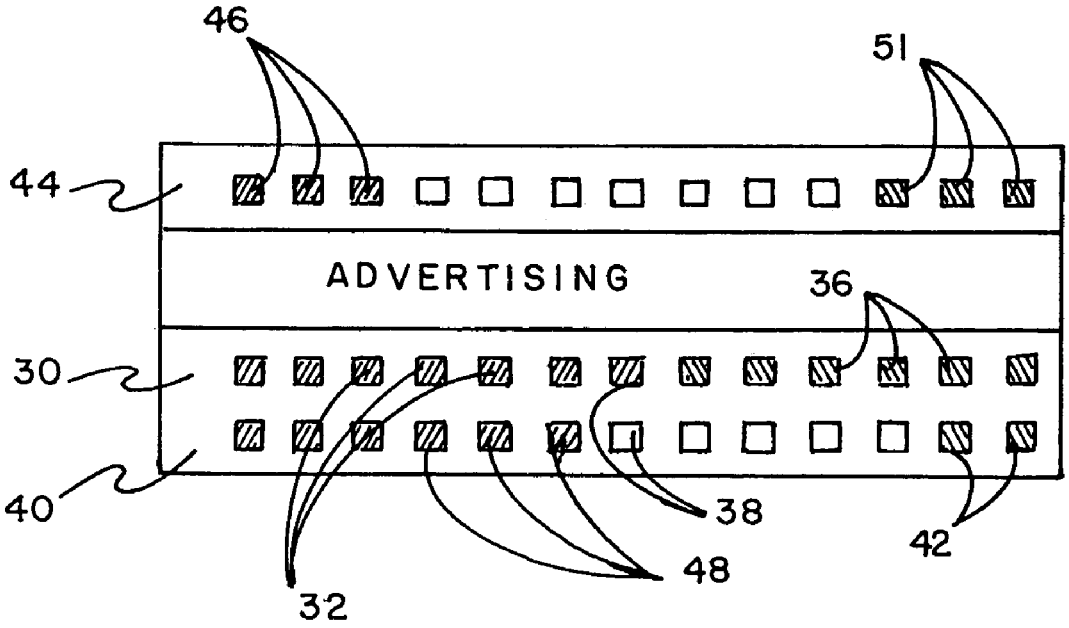
FIG. 4 illustrates an alternate embodiment of the tennis scoring device of this invention wherein one player's scoring bar for each of three possible sets is placed adjacent to his opponent's scoring bar and forming three elongated, horizontal scoring bars, each having thirteen colored indicia areas.

The various embodiments of the scoring device of this invention provide graphic depiction by means of colored indicia areas 18 for displaying the games won by each player in each set. These indicia areas can be of any shape, such as circles in the embodiment of FIG. 1 or they can be rectangles and squares such as seen in the embodiment of FIG. 4 or in other shapes not illustrated. In the embodiment shown in FIG. 1 each player has a scoring bar composed of seven indicia areas 18, each indicia area having the ability to display selected colors, as described below, to indicate the winner of a game played. In the embodiment of FIG. 1 display 12 is comprised of two scoring bars, being first scoring bar 14 and second scoring bar 16, with first scoring bar 14 disposed above second scoring bar 16. Each scoring bar is utilized by a different player or team, depending on whether it is a singles match or a doubles match, and that scoring bar displays that player's winning games and set(s) of the match. Although the scoring device of this invention can be utilized in both singles matches and doubles matches, for ease in describing the device and method of use of the system of this invention reference will only be made to two players competing in a singles match. In the embodiment of FIG. 1 the first scoring bar 14 denotes the winning games and set(s) of the first player and is comprised of seven, separate similar-sized color indicia areas 18. Each of the seven color indicia areas, which are round in this embodiment, indicate in a first color that no player has won a game but when changed to a second color indicates that the player has won a game represented by that round second color indicia area. The scoring device at the beginning of the match would have the indicia areas all be of the same color with seven indicia areas indicating the possible seven games that could be won by one player in a single set. Thus the seven indicia areas on each scoring bar represent the total number of games that might be scored in a tennis match. In the embodiment of FIG. 1 there is enough room to represent two sets. For example in FIG. 1 the score represented is 0-0 for the first set. As the tennis match progresses, after each game the players can approach the scoring device when changing sides at the end of each game and change the color of the indicia area on the scoring bar for the winner of the game that was just completed to show which player had won that game. If a player did not win that game, the color of the indicia area in his scoring bar would not be changed.

Figure 2:
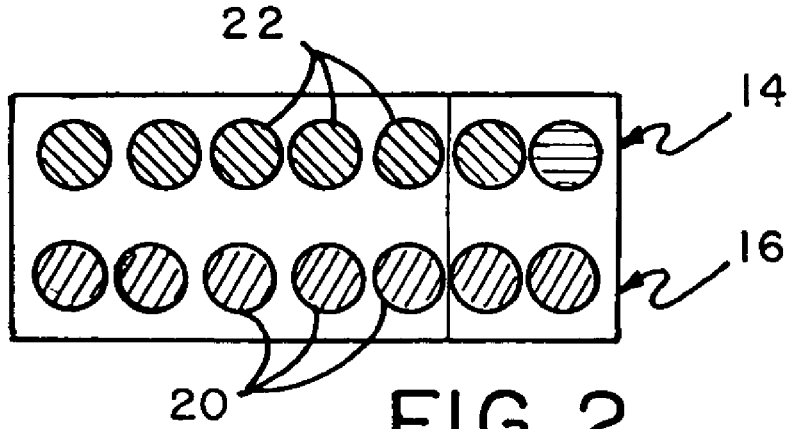
FIG. 2 illustrates a front view of the tennis scoring device of this invention showing a score of 6-7 in the first set from the seven colored indicia areas in the scoring bar of each player, each indicia area representing the possible games to be played in a set.

FIG. 2 illustrates the tennis scoring device of FIG. 1 after completion of the first set. When it is time to update the display unit after each game played, the winning player can change the color of the next indicia area in line on the scoring bar of the winner of that game would be changed. This change of color in the indicia area can be accomplished in many possible ways. One way is to provide a colored member that can be moved over the first color in the indicia area in the scoring bar to represent a game won. Another way is to have a ribbon of color with a clear portion attached thereto that can be passed within the display unit directed along each scoring bar such that when a player wins a game, that player can pull on the ribbon to move the colored portion in front of each adjacent indicia area that would then represent a game won in a set with the clear portion in front of the indicia areas representing unwon or unplayed games. Each player would be assigned a different color so that there would be different colors on each scoring bar to avoid confusion. Thus by observing the scoring device of this invention the players as well as any spectator of the tennis match could immediately determine how many games and sets had been played and what number of games and sets each player had won in the match. Other equivalent means of distinguishing what games and sets have been won using the display unit of this invention can also be utilized in the system and method of this invention.

In FIG. 2 the scoring of the games played in the first set is shown to be 6-7. The player using the lower second scoring bar 16 has seven different colored indicia areas 20, for example in the color orange, representing that that player has won seven games in the first set of the match. The other player utilizing upper first scoring bar 14 has only six indicia areas 22 in a different color such as green representing that he has won six games. In this way the players continue to change the color of the next appropriate indicia area to mark the games that each has won throughout the entire tennis match so that the score is recorded from start to finish.

Figure 3:
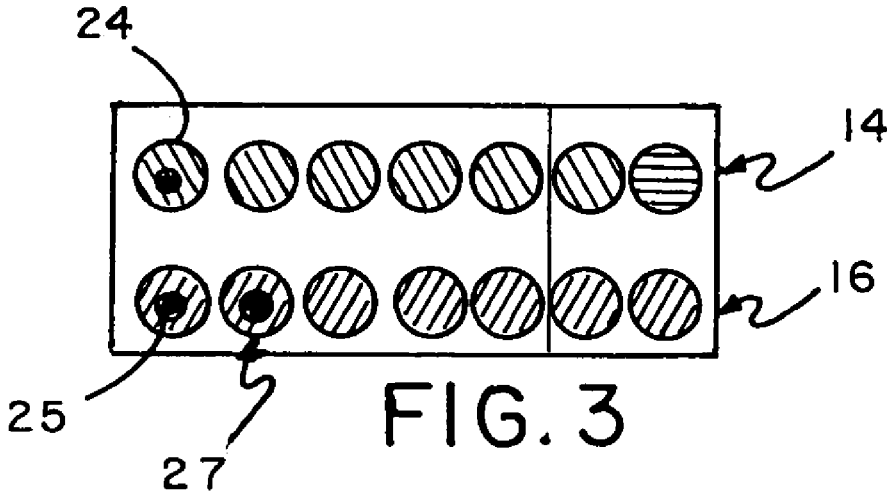
FIG. 3 illustrates a front view of the tennis scoring device of FIG. 2 showing the scoring of games won in a first set with additional overlapping color changed areas denoting the games won in a second set.

FIG. 3 illustrates the display unit shown in FIGS. 1 and 2, now showing that in the second set of the match the score is 1-2. The player utilizing the upper first scoring bar 14 has six green indicia areas representing the first set and now that player has one spot 24 in a different color represents one game won in the second set. The player utilizing the lower second scoring bar 16 has seven orange-colored indicia areas representing the two games that he won in the first set and two differently colored spots 25 and 27 representing games that he won in the second set.

FIG. 4 illustrates an alternate embodiment of the scoring device in matches which allows for the scoring of three sets. The players' scoring bars of indicia areas for each set are not placed one above the other but are placed side by side in a single, horizontally disposed row. For example, in the first set the first player would utilize first horizontal scoring bar 30 comprised of the leftmost six horizontally arranged rectangular indicia areas 32 and the second player would utilize the aligned rightmost six horizontally arranged rectangular indicia areas 36 to be color changed, one for each game won. A common seventh indicia area 38 in the center of each horizontal scoring bar can be used by either player winning the seventh game to decide the winner of a set having a score of 6-6 and thus requiring that another game be played to determine the winner of that set. In the example shown in first horizontal scoring bar 30 the first set's score is 7-6. The second set's score shown in second horizontal scoring bar 40 is 6-2, denoted by colored indicia areas 48 and 42. The third set can be denoted by third horizontal scoring bar 44 which depicts six leftmost colored indicia areas to be used by the first player and six rightmost colored indicia areas to be used by the second player and showing the three square colored indicia areas 46 for three games won by the first player and the three square colored indicia areas 51 won by the second player indicating a 3-3 score in games in the third set wherein no winner of that set has yet been determined.

Figure 5:
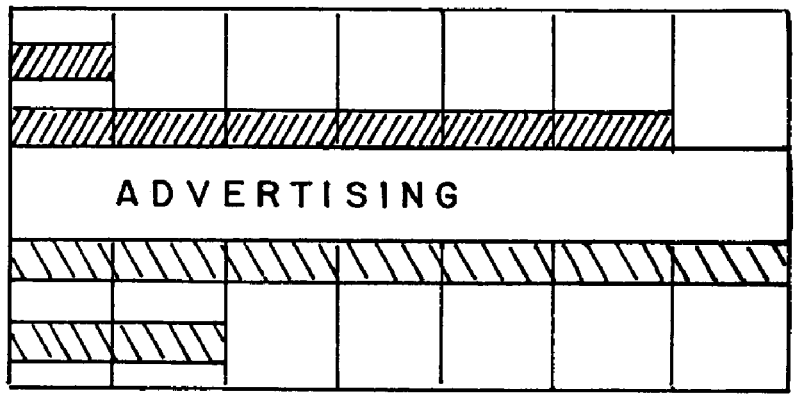
FIG. 5 illustrates a front view of an alternate embodiment of the tennis scoring device of this invention wherein each player's games won are denoted in scoring bars wherein the scoring bars of the second and third sets of one player are above the scoring bar of that player's first set scoring bar and the scoring bars of the second and third sets of the other player are below that player's scoring bar of the first set.

FIG. 5 illustrates a further alternate embodiment of the scoring device 12 of this invention wherein the scoring bar of indicia areas are rectangular in shape and are displayed for each player above and below an area 46 of the device provided for advertising or display of other information.

Figure 6:
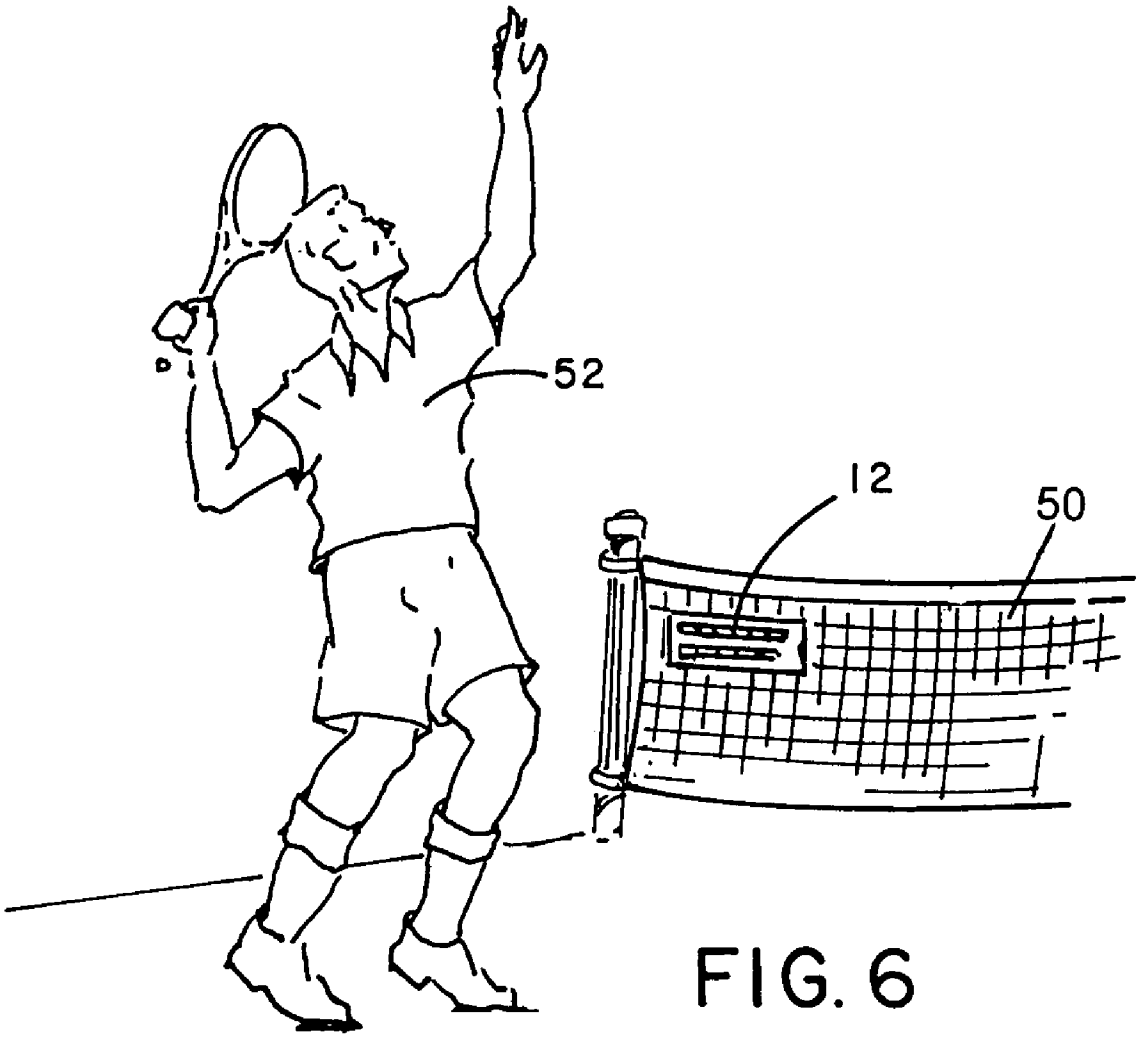
FIG. 6 illustrates a perspective view of a player in front of a tennis net with the tennis scoring device of this invention mounted thereon.

FIG. 6 illustrates the tennis scoring device 12 of this invention shown mounted on tennis net 50 in easy view of player 52. In a further embodiment when the scoring device of this invention is mounted on a tennis net, the openings in the net can correspond to the indicia areas and the scoring by the various methods discussed above can be visible by both players.

The use of the tennis scoring device of this invention has many benefits as it provides more information at a glance than current scoring cards provide. It displays a visual record of a match as it is being played as opposed to just a single score. This visual record prevents disputes on a match's scoring because the score of every single game and set is instantly perceived. The device is also an excellent indicator of a match's progress, enabling bystanders, coaches and even tournament directors to track the match in progress to be able to gauge the timing of the end of the match. This information is impossible to obtain using score cards as they do not display enough essential information, such as what set the match is in, what the score was in any of the previous sets, or other special features that can be displayed, for example, the round indicator, practice match, etc. Lastly, the scoring device can also be used for an assortment of practice drills.

The scoring device is extremely versatile whether it is created to be operated mechanically or have the color changed in the indicia areas electronically, such as by color changing LCDs located in the indicia areas. Not only is the scoring device easy to see, but also easy to use. It is designed to fit into several convenient locations, whether it is mounted on the net of a tennis court near the doubles alley, on a side fence, or the screened fence located between the courts. It can be double-sided so that it can be viewed from any direction. There is also room available on the device for advertising, if desired.

Although the present invention has been described with reference to particular embodiments, it will be apparent to those skilled in the art that variations and modifications can be substituted therefor without departing from the principles and spirit of the invention.

We claim:

1. A tennis scoring system for use by at least a first player and a second player playing a tennis match on a tennis court having a tennis net, comprising:

a display unit disposed in a position visible to said first and second players, said display unit having first and second scoring bars, said first and second scoring bars for use, respectively, by said first and second players; and a plurality of colored indicia areas arrayed on each of said first and second scoring bars, said colors of said colored indicia areas of said first scoring bar being of a different color from said color of said colored indicia areas of said second scoring bar, each of said colored indicia areas of each of said first and second scoring bars representing one of the games played in said tennis match, said color of one of said first colored indicia areas in said first scoring bar to be changed in sequence whenever said first player wins a game and said color of one of said second colored indicia areas in said second scoring bar to be changed in sequence whenever said second player wins a game until one of said players has won a first set in said match, said color of one of said first colored indicia areas in said first scoring bar to be changed in sequence to a different color whenever said first player wins a game in a second set of said match and said color of one of said second colored indicia areas in said second scoring bar to be changed in sequence to a different color whenever said second player wins a game in said second set until one of said players has won said second set, said tennis match continuing until one of said players has won two sets, said score of said tennis match consisting of games and sets won by said first and second players; said first and second scoring bars displaying the score of games and sets won by said first and second players during said tennis match.

2. The tennis scoring system of claim 1 wherein each of said first and second scoring bars contains seven colored indicia areas.

3. The tennis scoring system of claim 2 wherein said first and second scoring bars are disposed on said display unit one above the other in parallel alignment.

4. The tennis scoring system of claim 2 further including first and second colored members, said first and second colored members being of different colors wherein said color changing of said first and second colored indicia areas of said first and second scoring bars is accomplished by manual manipulation of different colored members, respectively, over said first and second colored indicia areas.

5. The tennis scoring system of claim 1 wherein said first and second scoring bars are joined together forming a single horizontal scoring bar having a first end and a second end, said horizontal scoring bar composed of thirteen indicia areas, said first scoring bar having its first through sixth colored indicia areas disposed horizontally starting at said first end; said second scoring bar having its first through sixth colored indicia areas disposed horizontally starting at said second end; said centermost colored indicia area serving as the seventh colored indicia area for each of said first and second scoring bars, said horizontal scoring bar for displaying said score of said tennis match.

6. The tennis scoring system of claim 5 further including a series of three of said horizontal scoring bars disposed one above the other on said display unit, each of said horizontal scoring bars for displaying the score of a different set in said tennis match; said horizontal scoring bars for displaying said score of said tennis match.

7. The tennis scoring system of claim 6 further including first and second colored members, said first and second colored members being of different colors wherein said color changing of said first and second colored indicia areas of said first and second scoring bars of said horizontal scoring bar is accomplished by manual manipulation of said different colored members, respectively, over said first and second colored indicia areas.

8. The tennis scoring system of claim 6 wherein said color changing of said colored indicia areas is accomplished by electronic means.

9. The tennis scoring system of claim 6 wherein said display unit has an area thereon for the placement of advertising or display of other information.

10. The tennis scoring system of claim 5 further including first and second colored members, said first and second colored members being of different colors wherein said color changing of said first and second colored indicia areas of said first and second scoring bars of said horizontal scoring bar is accomplished by manual manipulation of said different colored members, respectively, over said first and second colored indicia areas.

11. The tennis scoring system of claim 5 wherein said color changing of said colored indicia areas is accomplished by electronic means.

12. The tennis scoring system of claim 5 wherein said display unit has an area thereon for the placement of advertising or display of other information.

13. The tennis scoring system of claim 1 wherein said color changing of said colored indicia areas is accomplished by electronic means.

14. The tennis scoring system of claim 1 wherein said display unit is disposed on said tennis net facing one player and visible to the other player through the mesh of said tennis net.

15. The tennis scoring system of claim 1 wherein said display unit has an area thereon for the placement of advertising or display of other information.

16. A tennis scoring method for displaying the score of a tennis match played by at least a first and second player on a tennis court having a tennis net, comprising the steps of:

providing a display unit having a plurality of colored indicia areas arrayed on each of first and second scoring bars, said colors of said colored indicia areas of said first scoring bar being of a different color from said color of said colored indicia areas of said second scoring bar, each of said colored indicia areas of each of said first and second scoring bars representing one of the games played in said tennis match;

changing said color of one of said first colored indicia areas in said first scoring bar in sequence whenever said first player wins a game;

changing said color of one of said second colored indicia areas in said second scoring bar in sequence whenever said second player wins a game until one of said players has won a set;

changing said color of one of said first colored indicia areas in said first scoring bar in sequence to a different color whenever said first player wins a game in a second set of said tennis match;

changing said color of one of said second colored indicia areas in said second scoring bar in sequence to a different color whenever said second player wins a game in said second set;

continuing said steps of changing of colors of said colored indicia areas until one of said players has won two sets; and ascertaining said score of said games and sets won by said first and second players in said tennis match by observing said color changes of said first and second indicia areas in said first and second scoring bars on said display unit.

17. The method of claim 16 further including the step of disposing said display unit on said tennis net of said tennis court.

18. The method of claim 16 further including the step of changing said colored indicia areas by electronic means.

19. The method of claim 16 further including the step of placing advertising or other informational display on said display unit.

* * * * *